US012553227B1

(12) United States Patent
Jensen et al.

(10) Patent No.: US 12,553,227 B1
(45) Date of Patent: Feb. 17, 2026

(54) RETROFIT SENSOR KITS FOR DRINKING FOUNTAINS

(71) Applicant: LAITUS SOLUTIONS, LLC, Provo, UT (US)

(72) Inventors: Nathan Peter Jensen, Santa Ana, CA (US); Seth Brent Walker, Provo, UT (US); Zachary J. Walker, American Fork, UT (US); Ian Jensen, Everett, WA (US)

(73) Assignee: Laitus Solutions, LLC, Provo, UT (US)

( * ) Notice: Subject to any disclaimer, the term of this patent is extended or adjusted under 35 U.S.C. 154(b) by 732 days.

(21) Appl. No.: 17/820,866

(22) Filed: Aug. 18, 2022

Related U.S. Application Data

(60) Provisional application No. 63/260,390, filed on Aug. 18, 2021.

(51) Int. Cl.
*E03B 9/20* (2006.01)
*E03C 1/05* (2006.01)

(52) U.S. Cl.
CPC ..... *E03C 1/057* (2013.01); *E03B 9/20* (2013.01)

(58) Field of Classification Search
CPC ..... E03C 1/057; E03B 9/20; Y10T 137/86389
See application file for complete search history.

(56) References Cited

U.S. PATENT DOCUMENTS 3,491,381 A * 1/1970 Cathcart ..... E03C 1/057 4/623
4,872,485 A * 10/1989 Laverty, Jr. ..... E03C 1/057 137/624.11
4,942,631 A * 7/1990 Rosa ..... E03C 1/057 4/623
5,033,508 A * 7/1991 Laverty, Jr. ..... E03B 9/20 239/24
5,570,869 A * 11/1996 Diaz ..... E03C 1/057 4/304
5,730,165 A * 3/1998 Philipp ..... H03K 17/955 324/677
5,819,336 A * 10/1998 Gilliam ..... E03C 1/057 4/304
5,943,713 A * 8/1999 Paterson ..... E03C 1/057 4/623
2014/0345726 A1* 11/2014 Seggio ..... E03C 1/057 137/613

FOREIGN PATENT DOCUMENTS

CH 646765 A5 * 12/1984
FR 3109950 A1 * 11/2021
GB 529877 A * 11/1940

* cited by examiner

*Primary Examiner* — Marina A Tietjen
(74) *Attorney, Agent, or Firm* — Knobbe, Martens, Olson & Bear, LLP

(57) ABSTRACT

Embodiments of the present disclosure convert a drinking fountain into a touch-free drinking fountain. In an embodiment, the fountain retains its original activation functionality. In addition, a touchless circuit activates a preexisting electronic valve within the fountain responsive to a sensor determining a person is within a certain proximity. The touchless circuit installs into existing electronic fountains and is much more cost effective than replacement of an entire water fountain.

18 Claims, 16 Drawing Sheets

RETROFIT SENSOR KITS FOR DRINKING FOUNTAINS

The present application claims priority to U.S. Provisional Application No. 63/260,390, filed Aug. 18, 2021. The above-listed application and any and all other applications for which a foreign or domestic priority claim is identified in the Application Data Sheet as filed with the present application, are hereby incorporated by reference under 37 CFR 1.57.

TECHNICAL FIELD

The present disclosure relates to drinking fountains or other high-touch devices. Specifically, the present disclosure relates to retrofit kits to add touchless activation to conventional drinking fountains.

BACKGROUND

Society continues to exercise increasing caution with respect to public surfaces. Particularly since the onset of the COVID-19 pandemic, people choose a preventative approach to high touch surfaces like doorknobs, elevator buttons, and vending machines, to name a few. In response, businesses, property managers, and even residents block doors open or prevent access to reduce public touching of doorknobs. Further, people use knuckles to press buttons on elevators and vending machines.

However, options to reduce public touching of drinking fountains are limited. To have water flow at a traditional drinking fountain, a person pushes or otherwise activates a lever or button with a finger, hand, foot, or toe. The button mechanically links to a valve. The mechanical linkage translates motion at the lever or button into opening or closing a valve controlling the flow of pressurized water. Many property managers simply shut off this type of mechanical fountain.

Electronic drinking fountains differ from traditional drinking fountains by replacing the mechanical linkage discussed above with a wired electronic valve, solenoid valve, or the like. That is, when a person activates the lever or button, the activation is electronically communicated to a solenoid that, when activated (or in some cases deactivated), opens the valve.

Various makers of fountains provide retrofit products that change a traditional mechanical linkage-based fountain into the electronic-based fountain. The retrofit products are typically brand specific.

SUMMARY

Electronic drinking fountains rely on the same or similar high-touch lever or button to activate the water. The reliance on a high-touch surface may not meet the public aesthetics or even health codes, particularly during a pandemic.

In one aspect, retrofit kit configured to provide touch free activation to a touch drinking fountain while retaining original drinking fountain functionality includes, prior to installation on the touch drinking fountain, a kit including at least one proximity sensor; a switch; and at least one relay configured to connect to at least one activation line of the touch drinking fountain; wherein activating the at least one proximity sensor when the kit is attached to the touch drinking fountain causes the switch to connect the at least one relay to a power source of the touch drinking fountain; wherein connecting the at least one relay to the power source causes the at least one relay to provide energy to the at least one activation line of the touch drinking fountain; and wherein providing energy to the at least one activation line of the touch drinking fountain causes the touch drinking fountain to dispense a fluid.

The retrofit kit of any of the preceding paragraphs and/or any of the apparatuses, systems, or devices disclosed herein can include one or more of the following features. In some cases, the at least one proximity sensor can activate when the at least one proximity sensor detects a user's proximity. In some cases, the at least one proximity sensor can activate when the at least one sensor detects a predefined user gesture or motion. In some cases, the at least one sensor can be attached to an exterior surface of the touch drinking fountain or a surface adjacent to the touch drinking fountain. In some cases, the switch and the at least one relay can be positioned inside the touch drinking fountain when the kit is installed to the touch drinking fountain. In some cases, the relay can include a relay circuitry and at least one relay wire connected to the relay circuitry. In some cases, the switch and the relay circuitry can be positioned inside a housing. In some cases, the housing can be watertight. In some cases, the power source can include at least one of a battery and a power cord connected to an electricity supply via a wall socket. In some cases, activating an actuator of the touch drinking fountain can cause the touch drinking fountain to dispense fluid.

In another aspects, the retrofit sensor kit can include a housing configured to attach to a touch drinking fountain; at least one sensor having an activated mode and a deactivated mode; at least one relay wire connected to at least one activation line of the touch drinking fountain; and a power source; when the at least one sensor is in the activated mode, the at least one sensor can activate the at least one relay wire; activating the at least one relay wire can cause the power source to energize the at least one activation line of the touch drinking fountain; energizing the at least one activation line of the touch drinking fountain can cause the touch drinking fountain to dispense fluid; and when the at least one sensor is in the deactivated mode, the touch drinking fountain does not dispense fluid.

The retrofit kit of any of the preceding paragraphs and/or any of the apparatuses, systems, or devices disclosed herein can include one or more of the following features. In some cases, the at least one sensor includes a proximity sensor configured to detect a user's proximity. In some cases, the proximity sensor can transition from the deactivated mode to the activated mode when the proximity sensor detects the user's proximity. In some cases, the proximity sensor can transition from the activated mode to the deactivated mode when the proximity sensor does not detect the user's proximity. In some cases, the housing can be attachable to a portion of the touch drinking fountain. In some cases, the housing includes a first housing portion at least partially exposed when the housing is attached to the touch drinking fountain, a second housing portion positioned inside the touch drinking fountain when the housing is attached to the touch drinking fountain, and a panel between the first and second housing portions, the at least one sensor positioned inside the first housing portion and at least a portion of the at least one relay wire positioned inside the second housing portion. In some cases, the first housing portion includes a window. In some cases, the power source includes at least one of a battery and a power cord connected to an electricity supply via a wall socket. In some cases, activating an actuator of the touch drinking fountain can cause the touch drinking fountain to dispense fluid. In some cases, the housing can be watertight.

Embodiments of the present disclosure convert an electronic drinking fountain into hands-free activated drinking fountain. In an embodiment, a proximity sensor triggers the activation a preexisting electronic valve when a person is within a certain proximity. For example, a proximity sensor activates a solenoid valve without a touch or press of a button or lever. The hands-free mechanism is straightforward to install into existing electronic fountains. It is also much more cost effective than replacing comparatively very costly entire existing fountains.

Additional embodiments include a system for retrofitting a button-based solenoid activated drinking fountain with a touchless option. In some embodiments, the retrofit complements, as opposed to replaces, the activation of the fountain. For example, the fountain advantageously continues to operate as originally designed, and the retrofit straightforwardly adds a second mechanism to activate the fountain. The second mechanism may include an external sensor, such as, for example, a proximity sensor. The second mechanism may also include a sensor relay, and a relay driving circuit, such as, for example, a diode and transistor. The second mechanism advantageously provides an optional bypass to the button or lever.

For purposes of summarizing the disclosure, certain aspects, advantages, and novel features are discussed herein. It is to be understood that not necessarily all such aspects, advantages, or features will be embodied in any particular embodiment of the disclosure, and an artisan would recognize from the disclosure herein a myriad of combinations of such aspects, advantages, or features.

BRIEF DESCRIPTION OF THE DRAWINGS

Certain features of this disclosure are described below with reference to the drawings. The illustrated embodiments are intended to illustrate, but not to limit, the embodiments. Various features of the different disclosed embodiments can be combined to form further embodiments, which are part of this disclosure.

DETAILED DESCRIPTION

Overview

Figure 2:
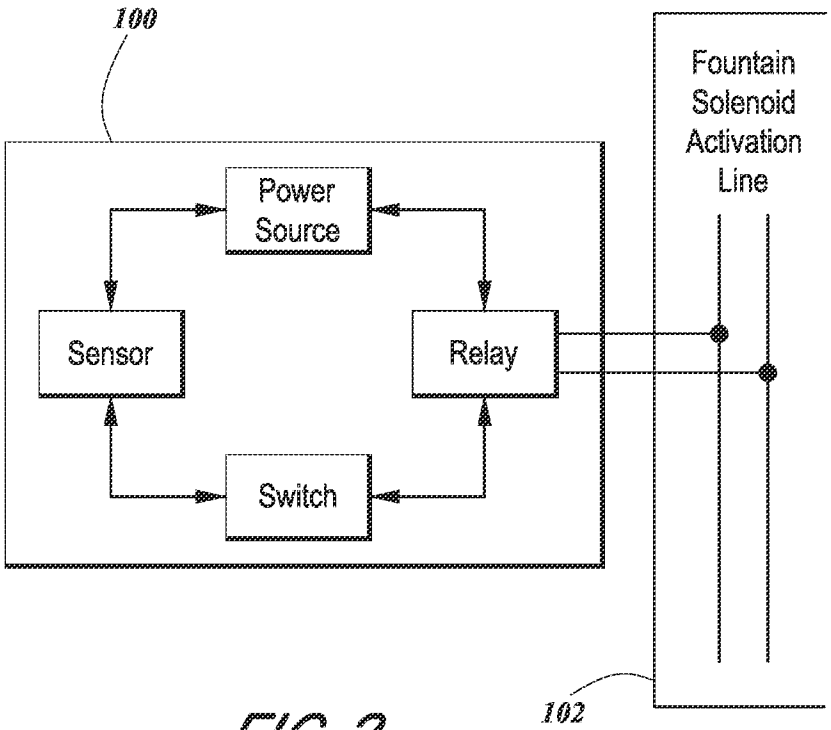
FIG. 2 shows a simplified block diagram of the touchless circuit of FIG. 1 communicating with an activation line of the drinking fountain, according to the disclosure.

Various features and advantages of this disclosure will now be described with reference to the accompanying figures. The following description is merely illustrative in nature and is in no way intended to limit the disclosure, its application, or uses. This disclosure extends beyond the specifically disclosed embodiments and/or uses and obvious modifications and equivalents thereof. Thus, it is intended that the scope of this disclosure should not be limited by any particular embodiments described below. The features of the illustrated embodiments can be modified, combined, removed, and/or substituted as will be apparent to those of ordinary skill in the art upon consideration of the principles disclosed herein.

DISCLOSURE

Embodiments of the present disclosure include systems and methods for upgrading or retrofitting a button-or lever-based solenoid activated drinking fountain to become touchless or hands-free. In an embodiment a touchless circuit interacts with the drinking fountain to provide hands free operation to a patron. For example, the touchless circuit activates when sensing the presence of the patron at a predefined distance or range of distances. In other embodiments, the touchless circuit senses a movement of the patron. For example, a patron wanting to activate the fountain may wave a hand, kick a foot, place a static hand/foot in front of a sensor, lean sufficiently close to the sensor, place their head/face a certain distance to the sensor, approach the fountain, or the like. In other embodiments, the sensor may be gesture driven. In still other embodiments, a patron's phone, laptop, watch, electronic wallet, authorization/ID card, RFID tag, or other computing device may communicate with a sensor to provide proximity and/or authorization. In high traffic embodiments, the sensor may include a delay that ensures that a patron is actually stopping at the fountain and not passing by. The delay may use feedback to adjust the delay to be uniquely suited to a particular location. In still additional embodiments, the sensor may receive audible voice. The touchless circuit may interpret voice commands to activate the sensor, may authenticate a user's voice, and the like. Still other embodiments include wireless communication with a device may advantageously activate the fountain without a sensor. That is, a computing device may interact with an internet site, application, intranet, local network, private network, mobile network, combinations of the same or the like, to activate the fountain. In some embodiments, once activated, an automatic timer may deactivate the fountain once expired if not deactivated sooner.

An artisan will recognize from the disclosure herein many off-the-shelf commercially-available proximity sensors that activate or deactivate based on the presence or absence (or reverse, absence or presence) of some portion of or all of a patron. In an embodiment, the sensor is based on received light. In other embodiments, the sensor is responsive to sound, acceleration, gyroscopic movement, vibration, combinations of the same of the like.

Certain embodiments include a touchless circuit that is low cost, yet straightforward too apply to the existing fountain. In add embodiments such a touchless circuit is also aesthetically pleasing while not distracting.

Figure 1:
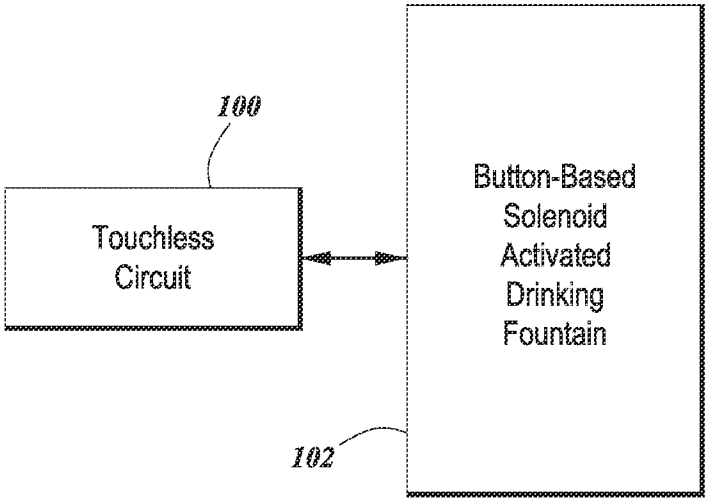
FIG. 1 shows a simplified block diagram of an exemplary embodiment of a touchless circuit communicating with a drinking fountain, according to the disclosure.

FIG. 1 shows a block diagram of an exemplary embodiment of a touchless circuit 100 according to embodiments of the present disclosure. FIG. 1 also shows touchless circuit 100 communicates with a button-based solenoid activated drinking fountain 102. In add embodiment, the communication adds to the functionality of the drinking fountain 102. That is, the drinking fountain 102 continues to operate as originally provided by its manufacturer and the touchless circuit 100 adds the functionality of hands-free or touchless activation by a patron.

An artisan will recognize from the disclosure herein that the touchless circuit 100 could be battery powered, powered through a standard outlet, obtain its power from the power used by the drinking fountain, or any other type of power supply (e.g., solar, local generator, etc.), combinations of the same or the like. For example, a drinking fountain may plug into a standard outlet and convert standard outlet power into desired power for the fountain using a typical power source converter. The touchless circuit 100 may advantageously connect to such a power source.

FIG. 2 shows a block diagram of an embodiment of the touchless circuit 100. For example, FIG. 2 shows the touchless circuit 100 including a sensor communicating with a power source and a switch, which in turn communicate with a relay. The relay communicates with the activation line of the drinking fountain 102. In an embodiment, the sensor can include a proximity sensor configured to activate or deactivate upon the presence of the patron. For example, the sensor may activate when a patron is within a predetermined distance from the sensor and/or the fountain 102. In other embodiments, the sensor may activate when an appendage comes within a certain distance from the sensor and/or the fountain 102. In still other embodiments, the sensor may activate when the patron makes certain gestures, series of gestures or other predetermined motions. Such gestures or motions can be directed by instructions placed on or near the fountain 102.

Upon activation of the sensor, the switch may connect the relay to the power source and the relay may provide energy from the power source to the activation line of the fountain 102. In an embodiment, the fountain supplies power. In other embodiments, a standard outlet may supply power. An artisan will recognize from the disclosure herein that the power sufficient to activate the solenoid may be provided by the drinking fountain power source, a standard wall outlet, the touchless circuit 100, a power converter, combinations of the same or the like. In an embodiment, the communication from the relay may advantageously provide a second option for activating the fountain 102. That is, the original option from the manufacturer may still be active through the activation line by, for example, depressing a button, lever or the like.

An artisan will recognize from the disclosure herein that the activation and deactivation could be reversed. That is, the relay could be providing energy, and upon activation of the sensor, the relay could discontinue such energy to cause the fountain 102 to dispense fluid.

Figure 3A:
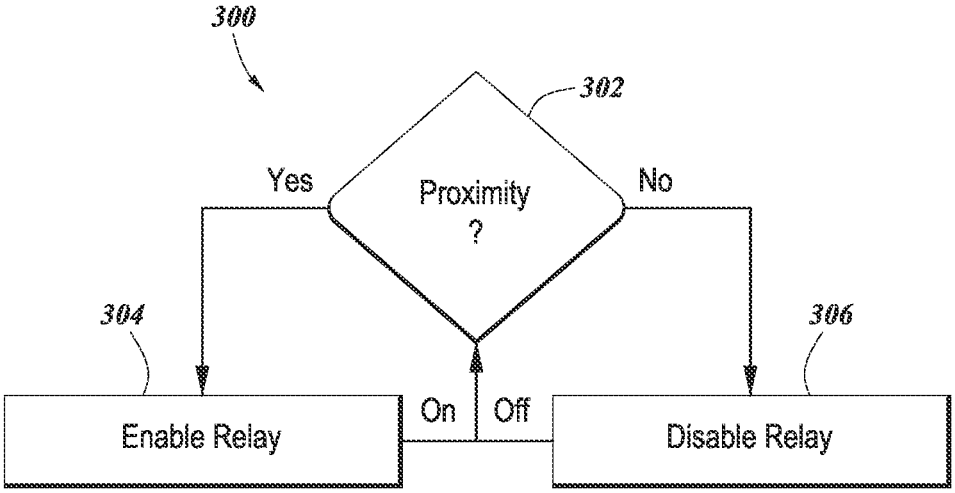
FIG. 3A shows a simplified flow diagram of an exemplary embodiment of a control process executed by an embodiment of the touchless circuit, according to the disclosure.

FIG. 3A shows a simplified flow diagram of an exemplary embodiment of a control process 300 of the touchless circuit 100. In an embodiment, the touchless circuit 100 activates the existing system within the fountain to cause water or other fluid to flow. For example, when the proximity sensor registers movement, presence, or the like, (as designed into a specific type of proximity sensor) the sensor activates, thereby causing the existing features within the drinking fountain to flow water.

FIG. 3A shows the control process 300 begins with a determination at block 302 that a patron is it within a predetermined proximity of the sensor. When the sensor determines a patron is present, the control process 300 proceeds to block 304 and the touchless circuit 100 enables the relay. In an embodiment, activation of the relay causes the drinking fountain 102 to dispense water. The control process 300 returns to block 302. When in block 302 the sensor determines a patron is not present, the control process 300 proceeds to block 306 and touchless circuit 100 disables the relay. In an embodiment, disablement of the relay causes the drinking fountain 102 to cease dispensing water. The control process 300 returns to block 302.

An artisan would recognize from the disclosure herein that the control process 300 could be a state machine such that once the drinking fountain 102 is turned ON, it remains ON until the proximity sensor provides the disable relay in block 306. Likewise, the control process 300 could remain off until the proximity sensor provides the enable relay in block 302. Additionally, the signals could be reversed. That is, the control process 300 could provide the relay for an off state and disable the relay for an ON state. The artisan would also recognize from the disclosure herein that changes to the control process 300 and the touchless circuit 100 could advantageously change to conform or be better suited for the existing system of and existing drinking fountain 102. Particularly, the touchless circuit 100 may advantageously piggyback on the existing fountain system to provide a straightforward alternative way of activating the fountain's solenoid valve to cause the drinking fountain to dispense water without the patron interacting with the drinking fountain in any touch-based way.

Figure 3B:
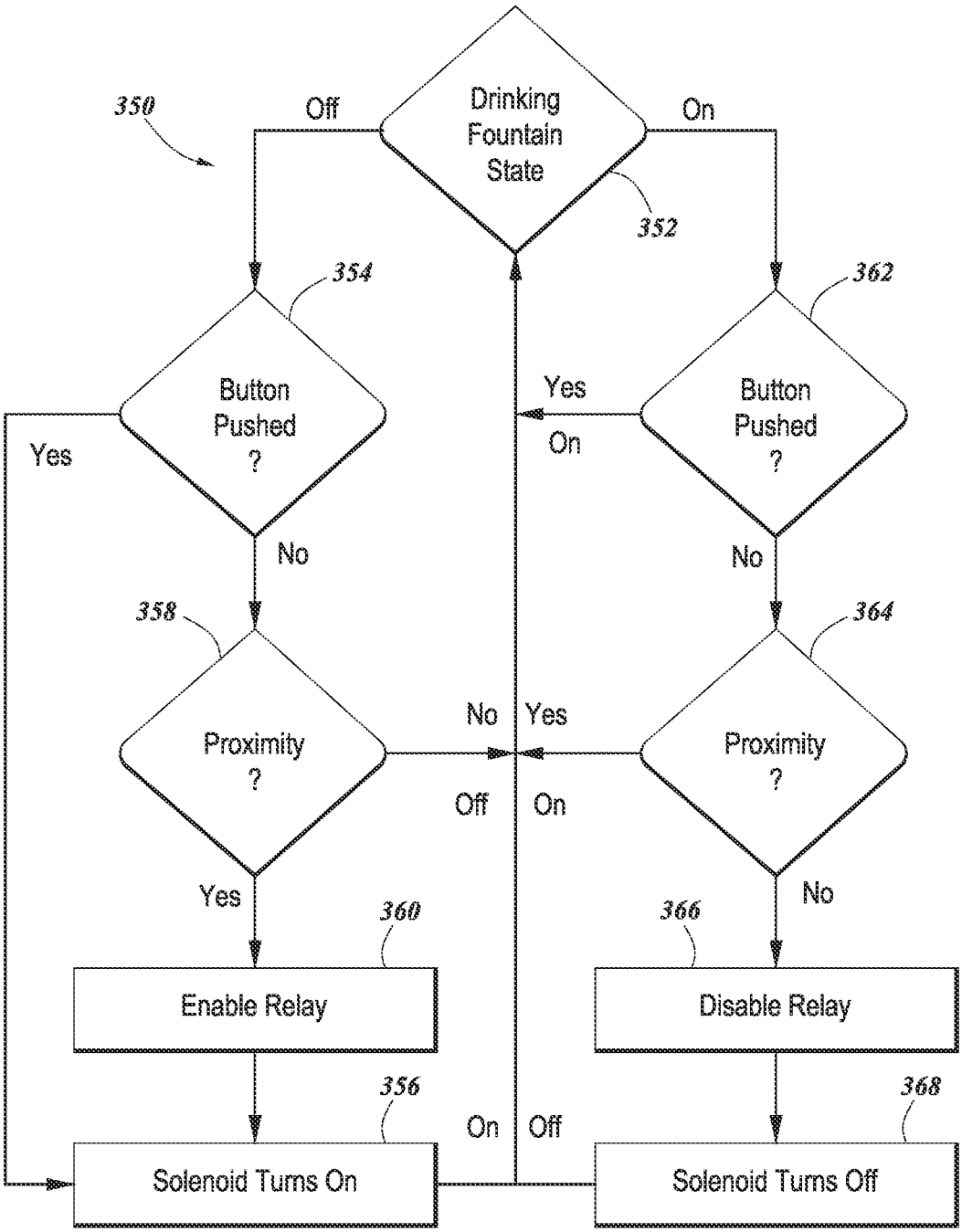
FIG. 3B shows a simplified flow diagram of an exemplary embodiment of a combination process executed by an embodiment of the touchless circuit operating in combination with the drinking fountain, according to the disclosure.

FIG. 3B shows a simplified flow diagram of an exemplary embodiment of a combination process 350 executed by an embodiment of the touchless circuit 100 operating in combination with the drinking fountain 102, according to the disclosure. In FIG. 3B, the drinking fountain 102 is treated as a state machine that is either in an "ON" state dispensing fluid, or in an "OFF" state not dispensing fluid. An artisan will recognize from the disclosure herein other control methodologies not reliant on a state machine implementation.

FIG. 3B includes block 352 for determining the state of the drinking fountain 102. When the state is OFF, meaning the fountain is not dispensing fluid, the combination process 350 continues to block 354. In block 354, the fountain 102 determines whether a button has been pushed, a lever has been activated, or some other mechanical interaction has occurred between the fountain 102 and the patron. When it has, the combination process 350 continues to block 356, where the drinking fountain 102 activates the solenoid valve controlling the supply of fluid. That is, the fountain 102 delivers water to the patron. The state of the fountain 102 is ON. This button-based mechanism was part of the existing drinking fountain 102.

When in block 354, the fountain 102 determines that the button has not been pushed, the combination process 350 proceeds to block 358. At block 358, the touchless circuit 100 determines whether or not a patron has activated the sensor. As provided above, activation of the sensor may advantageously include moving within a predetermined distance to the sensor, waving or holding an appendage in front of the sensor, performing a predetermined gesture, or the like. When the sensor determines that the patron has not activated the proximity sensor, the combination process 350 returns to block 352 and the state of the fountain 102 continues to be OFF. On the other hand, when the sensor senses the presence of a patron, the combination process 350 proceeds to block 360 and the touchless circuit 100 enables the relay. The combination process 350 continues to block 356 and the touchless circuit 100 activates the solenoid valve. As disclosed, the fountain 102 dispenses fluid and the state is ON.

Accordingly, the combination process 350 advantageously allows for the activation of the drinking fountain through either the push of a button (or other existing mechanism) or the patron coming within proximity of the sensor of the touchless circuit 100. Either activity provides its own path to fountain activation without reliance on the other activity.

FIG. 3B also shows the drinking fountains state could be ON at block 352. When the drinking fountain state is ON, the combination process 350 proceeds to block 362 where the fountain 102 determines whether a button is pushed. When the button is pushed, the combination process 350 returns to block 352 and the state of the drinking fountain remains ON. Otherwise, in block 362, when the button is not pushed, the combination process 350 proceeds to block 364, where the touchless circuit 100 determines whether a patron is within proximity to the sensor.

When the touchless circuit 100 determines that the patron is within a predetermined proximity at block 364, the combination process 300 returns to block 352 and the state of the fountain 102 remains ON. Alternatively, at block 364, if the touchless circuit 100 determines the patron is not within proximity, or no longer within proximity, the combination process 350 proceeds to block 366 and the touchless circuit 100 disables the relay. The combination process 352 continues to block 368 and the fountain 102 turns the solenoid off. The state of the fountain 102 is now OFF and the combination process 350 returns to block 352.

Figure 4A:
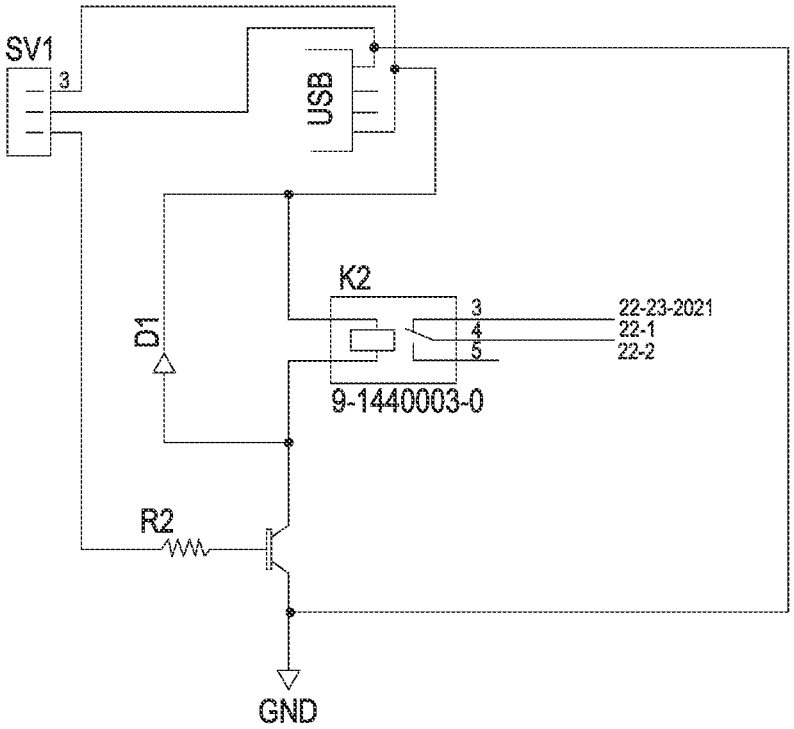
FIG. 4A shows a simplified exemplary schematic of embodiments of the touchless circuit according to the disclosure.

FIG. 4A shows a simplified exemplary schematic and layout of embodiments of the touchless circuit according to the disclosure. For example, FIG. 4A shows a switch comprising a transistor, and a drive circuit for the relay including the switch and a diode.

Figure 4B:
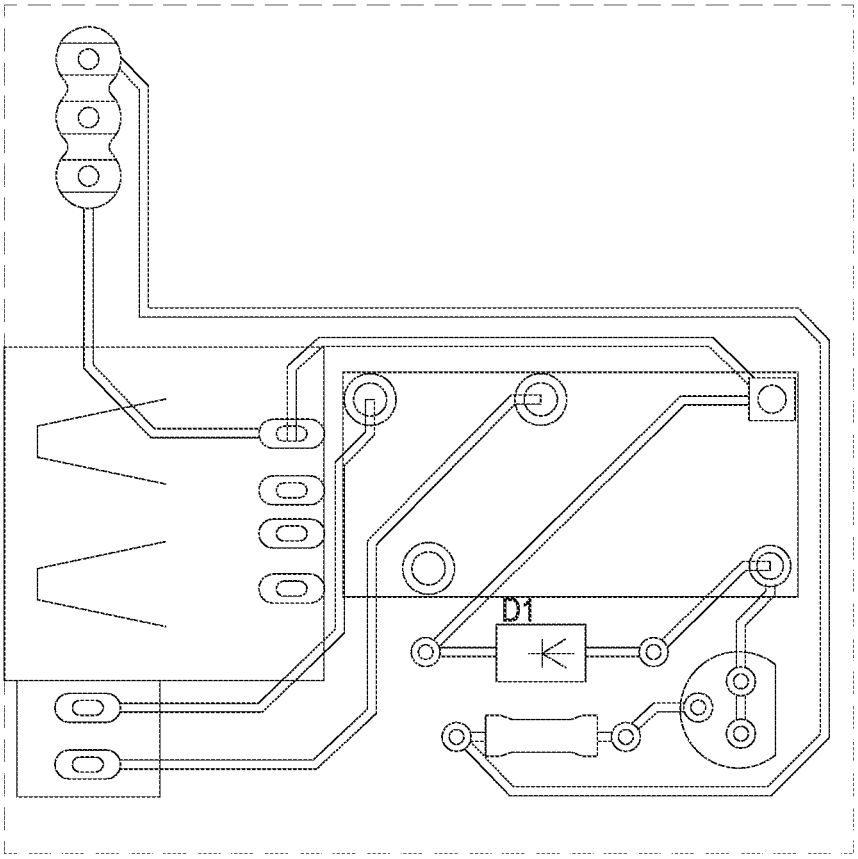
FIG. 4B shows a simplified exemplary PCB board including exemplary electrical components and conductive tracing according to embodiments of the touchless circuit of the disclosure

FIG. 4B shows a simplified exemplary PCB board including exemplary electrical components and conductive tracing according to embodiments of the touchless circuit of the disclosure.

Figure 5A:
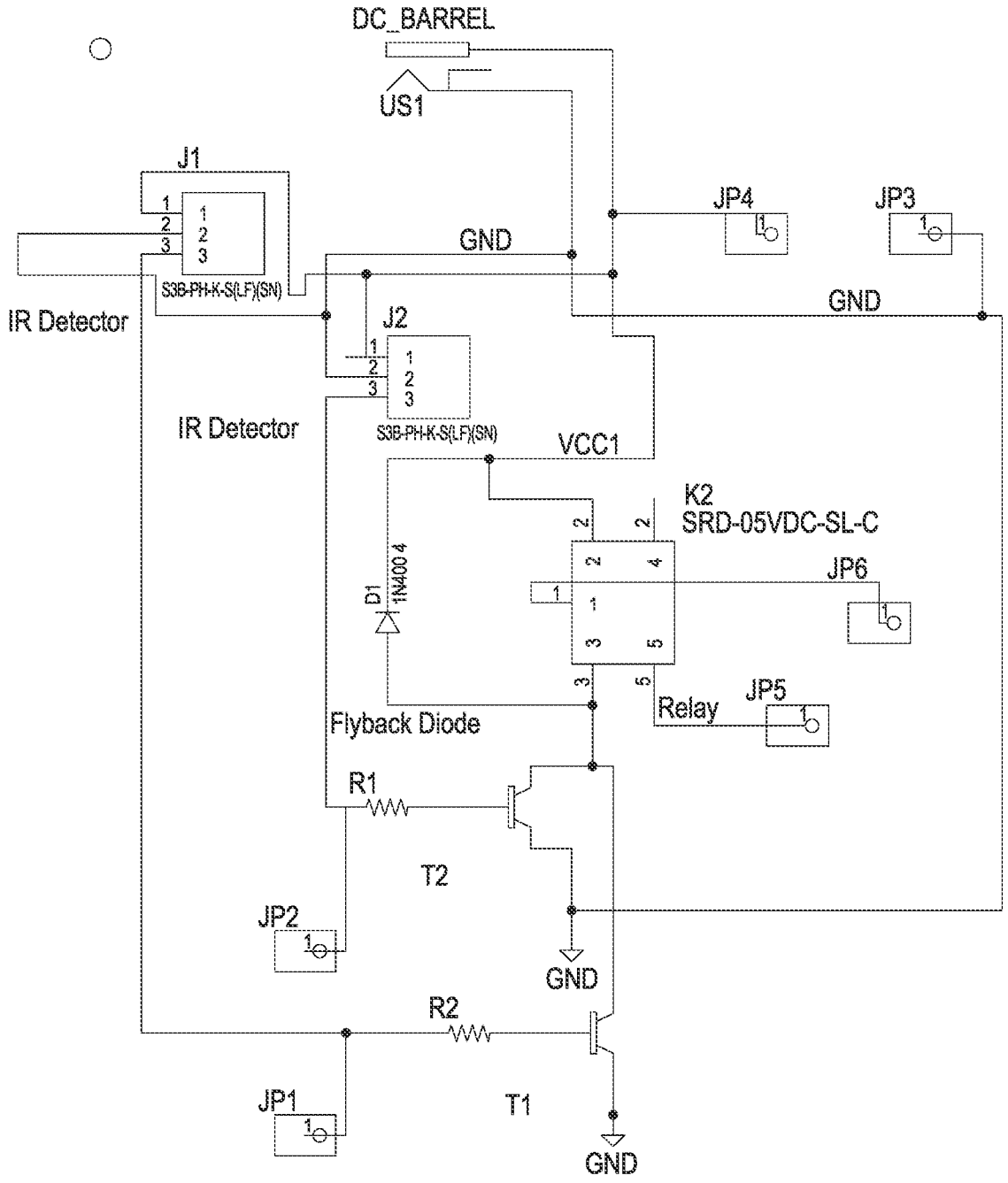
FIG. 5A shows another simplified exemplary schematic of embodiments of the touchless circuit according to the disclosure.

FIG. 5A shows another simplified exemplary schematic and layout of embodiments of the touchless circuit according to the disclosure. For example, FIG. 5A shows a switch comprising a transistor, and a drive circuit for the relay including the switch and a diode.

Figure 5B:
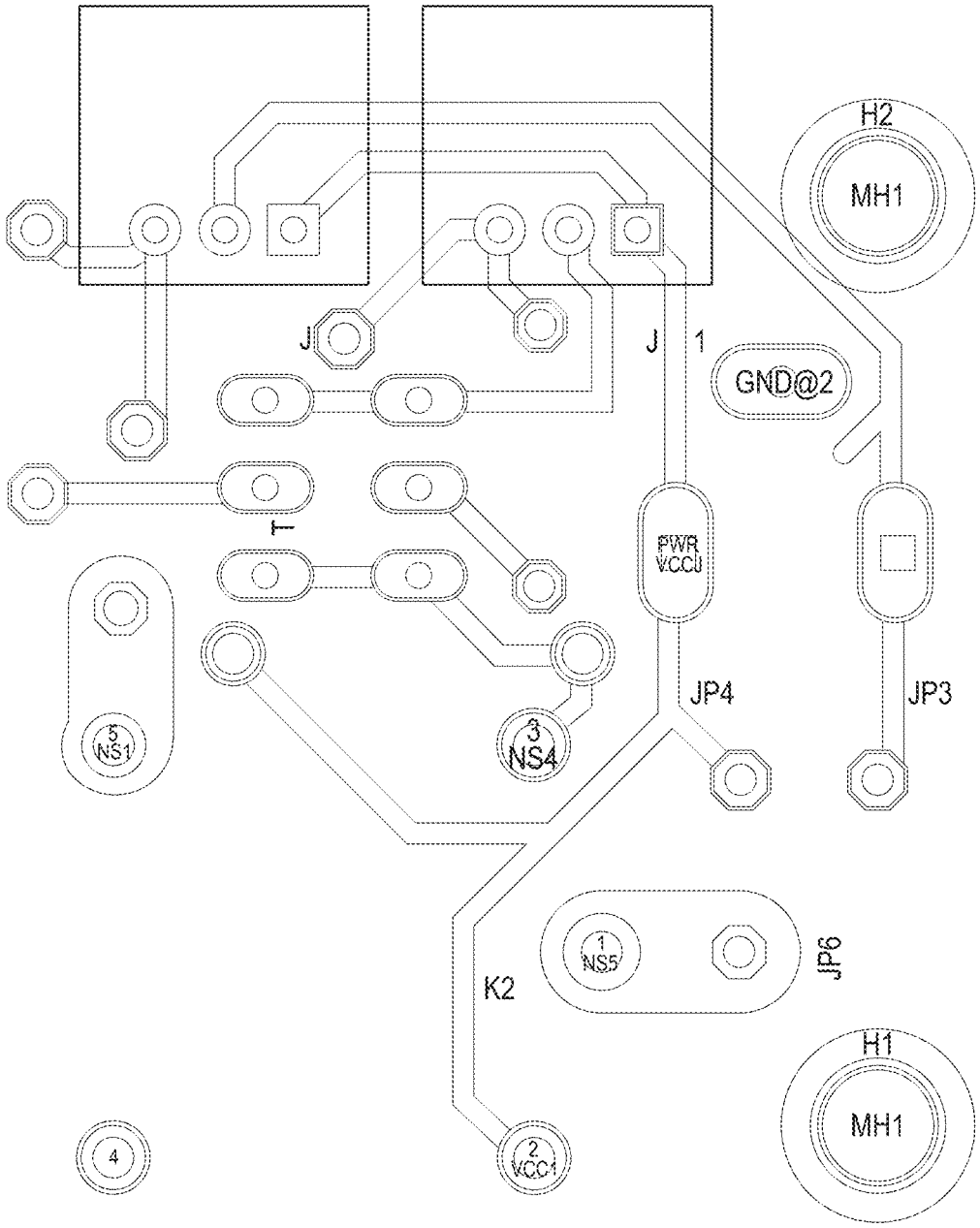
FIG. 5B shows another simplified exemplary PCB board including exemplary electrical components and conductive tracing according to embodiments of the touchless circuit of the disclosure

FIG. 5B shows another simplified exemplary PCB board including exemplary electrical components and conductive tracing according to embodiments of the touchless circuit of the disclosure.

Figure 6:
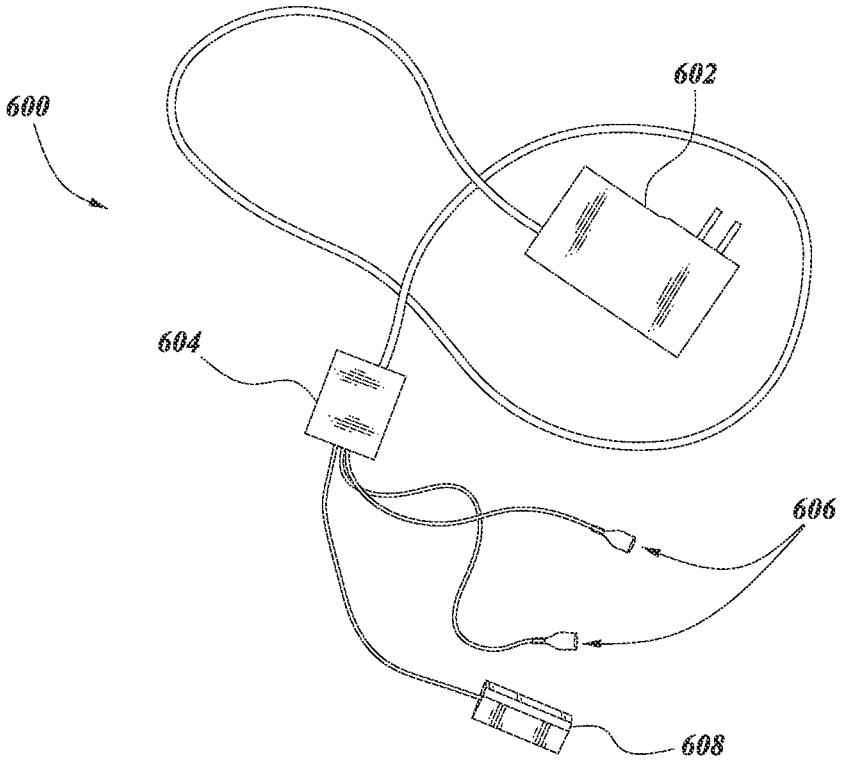
FIG. 6 shows a picture of an exemplary embodiment of the touchless circuit configured to electrically communicate with a standard power source.

FIG. 6 shows a picture of an exemplary embodiment of a touchless circuit 600 configured to electrically communicate with a standard power source. As shown, the circuit 600 includes a power cord 602, a housing 604, relay wires 606, and a proximity sensor 608. The circuit 600 may advantageously be commercially provided as a retrofit kit for existing drinking fountains. The housing 604 may include an adhesive backing, screw hole, or other fastener material and/or mechanism so that it adheres or can be positioned on the fountain 102. Alternatively, the housing 604 may be sufficiently light that it may not require fixed or semi-fixed positioning. Housing 604 advantageously protects the switch and relay circuitry from the environment, and in some embodiments the housing maybe water tight, water resistant or the like. The relay wires 606 may advantageously include electronic fasteners to allow for straightforward application to wires of the drinking fountain 102.

An artisan will recognize from the disclosure herein that the kit may be sold without the power cord 602. For example, the kit may include additional cabling allowing the touchless circuit 600 to connect to the internal power of the drinking fountain 102.

Figure 7:
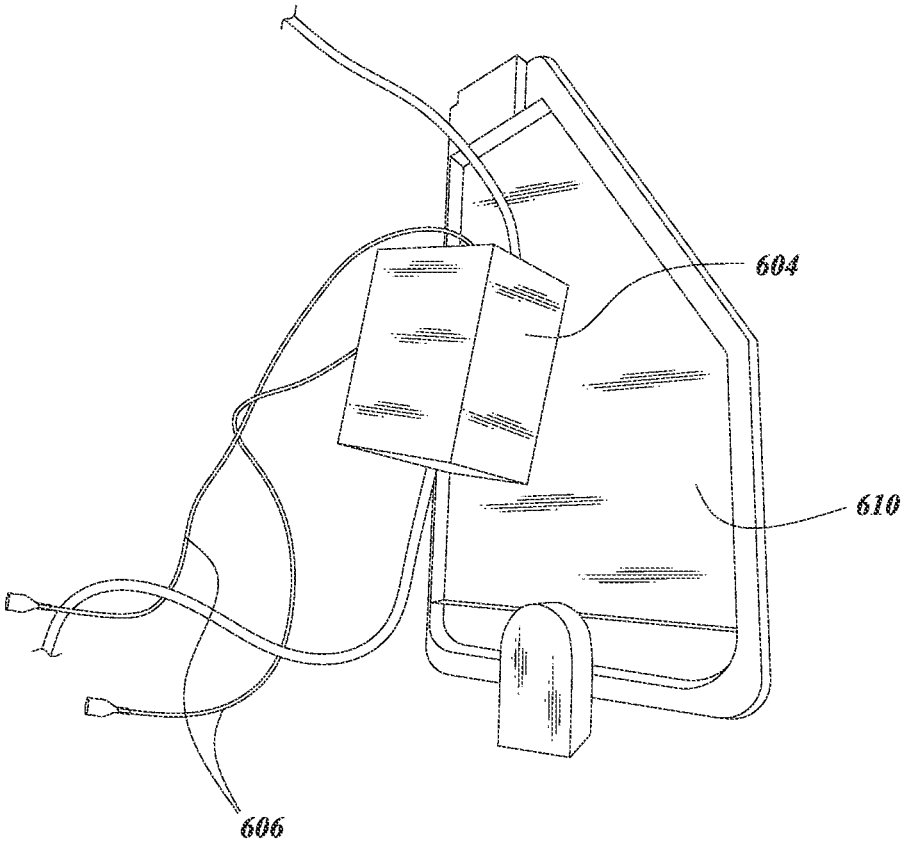
FIG. 7 shows a picture of the touchless circuit of FIG. 6 applied to a drinking fountain
Figure 8:
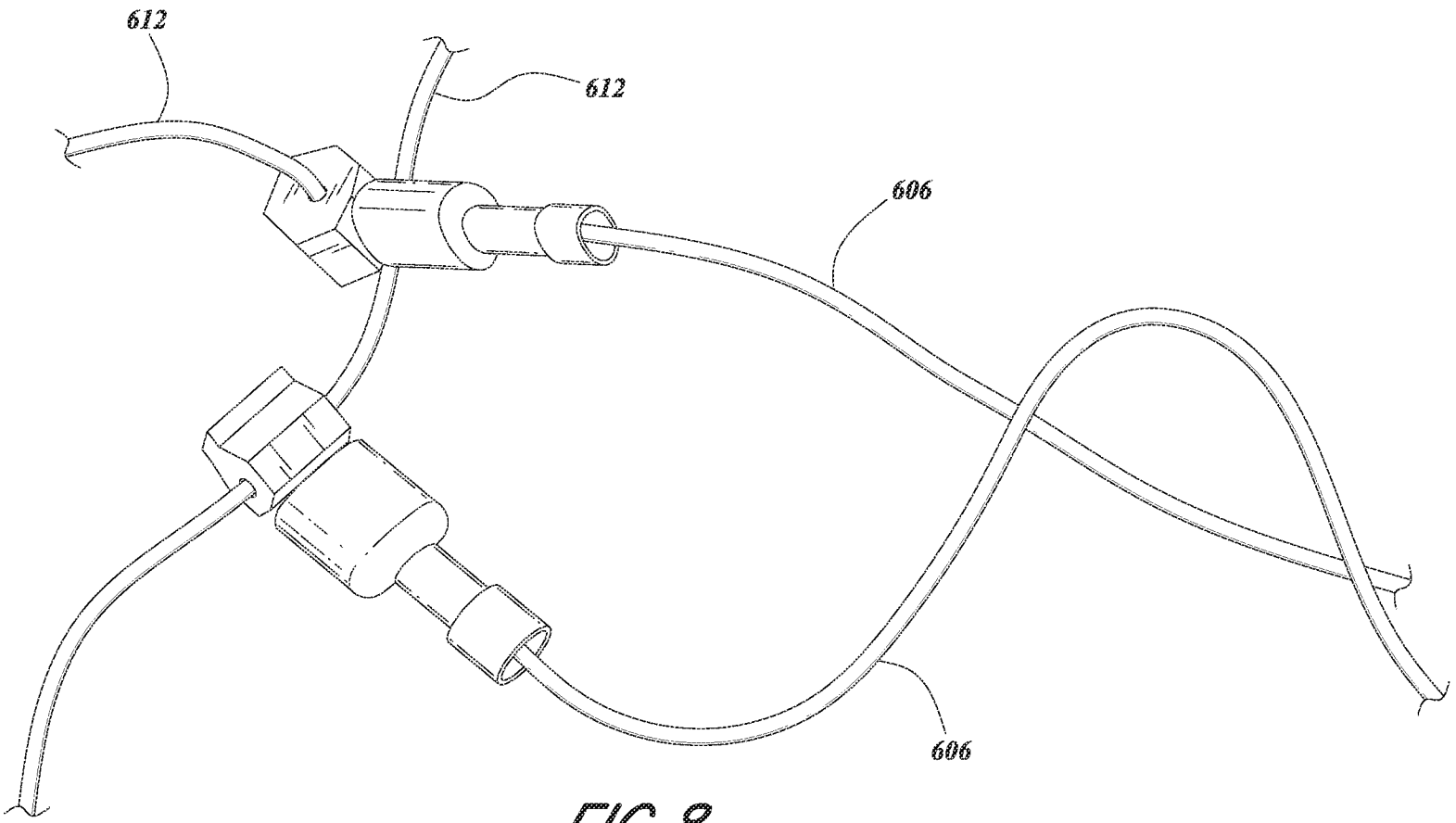
FIG. 8 shows a picture of relay conductors of the touchless circuit of FIG. 6 attached to the activation lines of the drinking fountain.
Figure 9A:
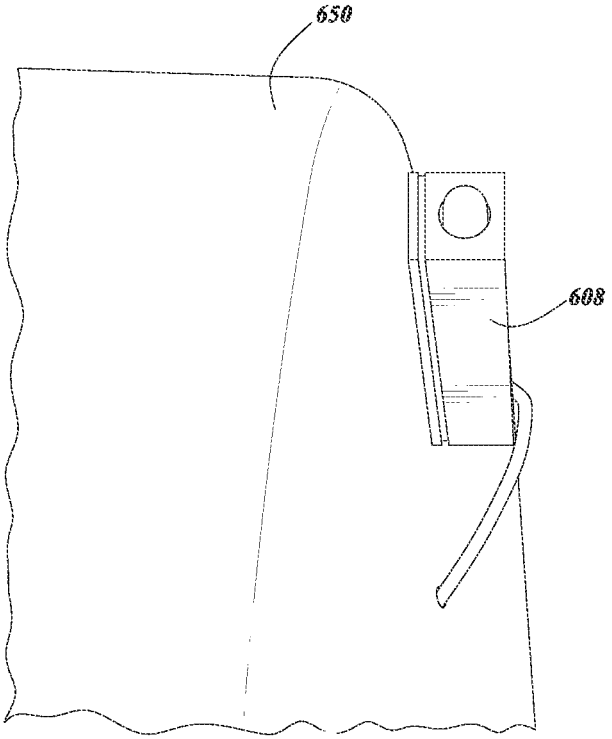
FIGS. 9A and 9B show pictures of a proximity sensor of the touchless circuit of FIG. 6 applied to the drinking fountain.
Figure 9B:
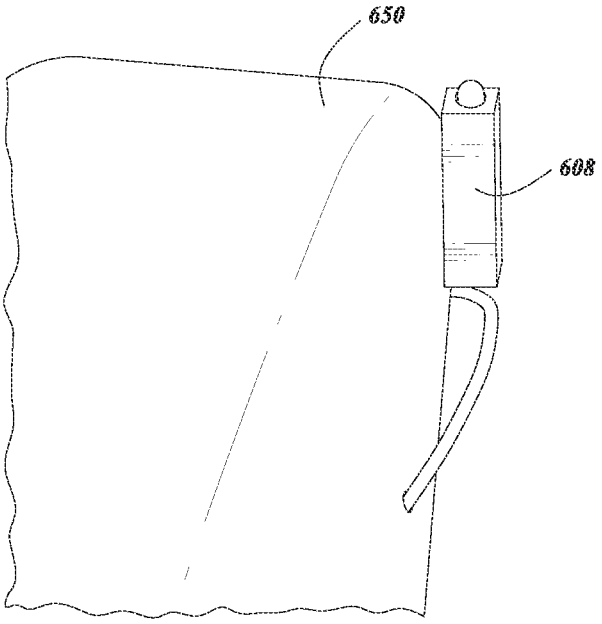

FIG. 7 shows a picture of the touchless circuit of FIG. 6 applied to a drinking fountain. FIG. 8 shows a picture of relay wires 606 of the touchless circuit of FIG. 6 attached to the activation lines 612 of the drinking fountain. A panel 610 can be attached to an exterior portion of the drinking fountain. The panel 610 can include an opening creating a passageway between an interior portion of the drinking fountain and the exterior of the drinking fountain. The sensor 608 and FIGS. 9A and 9B show pictures of a proximity sensor 608 of the touchless circuit of FIG. 6 applied to the drinking fountain 650. In an embodiment, the proximity sensor 608 includes a housing with an attachment mechanism. The attachment mechanism positions the proximity sensor on the drinking fountain 608. An artisan will recognize from the disclosure herein that the attachment mechanism could be adhesives, magnets, Velcro, screws, bolts, mating detents, mechanical mating mechanisms, combinations of the same or the like. As shown in FIGS. 9A and 9B, the sensor 608 may be positioned on the drinking fountain 650 in an area likely to register the presence of a patron. For example, it can be positioned at a top corner of the drinking fountain 650.

FIGS. 10-14 show another example of a retrofit sensor kit for a drinking fountain. The retrofit sensor kit can include a housing 700, a sensor 710, a relay 720, a switch, and a power source. In some cases, the housing 700 of the retrofit sensor kit includes a first housing portion 702, a second housing portion 704, and a panel 705 between the first housing portion 702 and the second housing portion 704. The panel 705 can include an opening 705*a* that creates a passage between the panel 705 and an interior portion of the first housing portion 702. The housing 700 can be attached to a drinking fountain 750 using adhesives, magnets, Velcro, screws, bolts, mating detents, mechanical mating mechanisms, and combinations of the same or the like. When housing 700 of the retrofit sensor kit is attached to the drinking fountain 750, at least some of the electrical components of the retrofit sensor kit, including, but not limited to the relay 720, are positioned inside the drinking fountain 750. Isolating the electrical components of the retrofit sensor kit from users can prevent users from directly touching or manipulating the electrical components. Beneficially, this can reduce the risk of electrical shocks that can result in serious injury or death.

Figure 10:
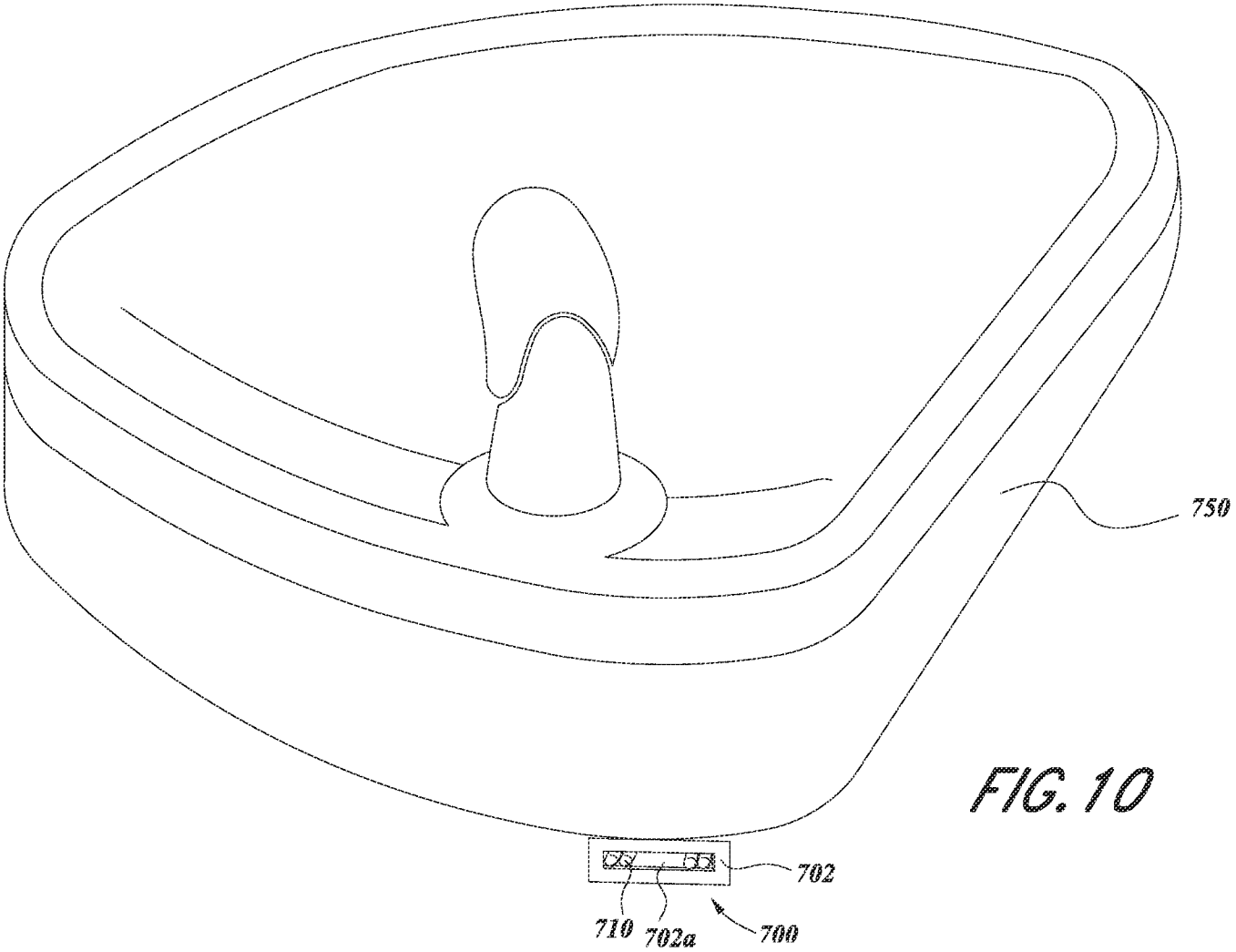
FIGS. 10-12 show an embodiment of a retrofit sensor kit attached to a drinking fountain.
Figure 12:
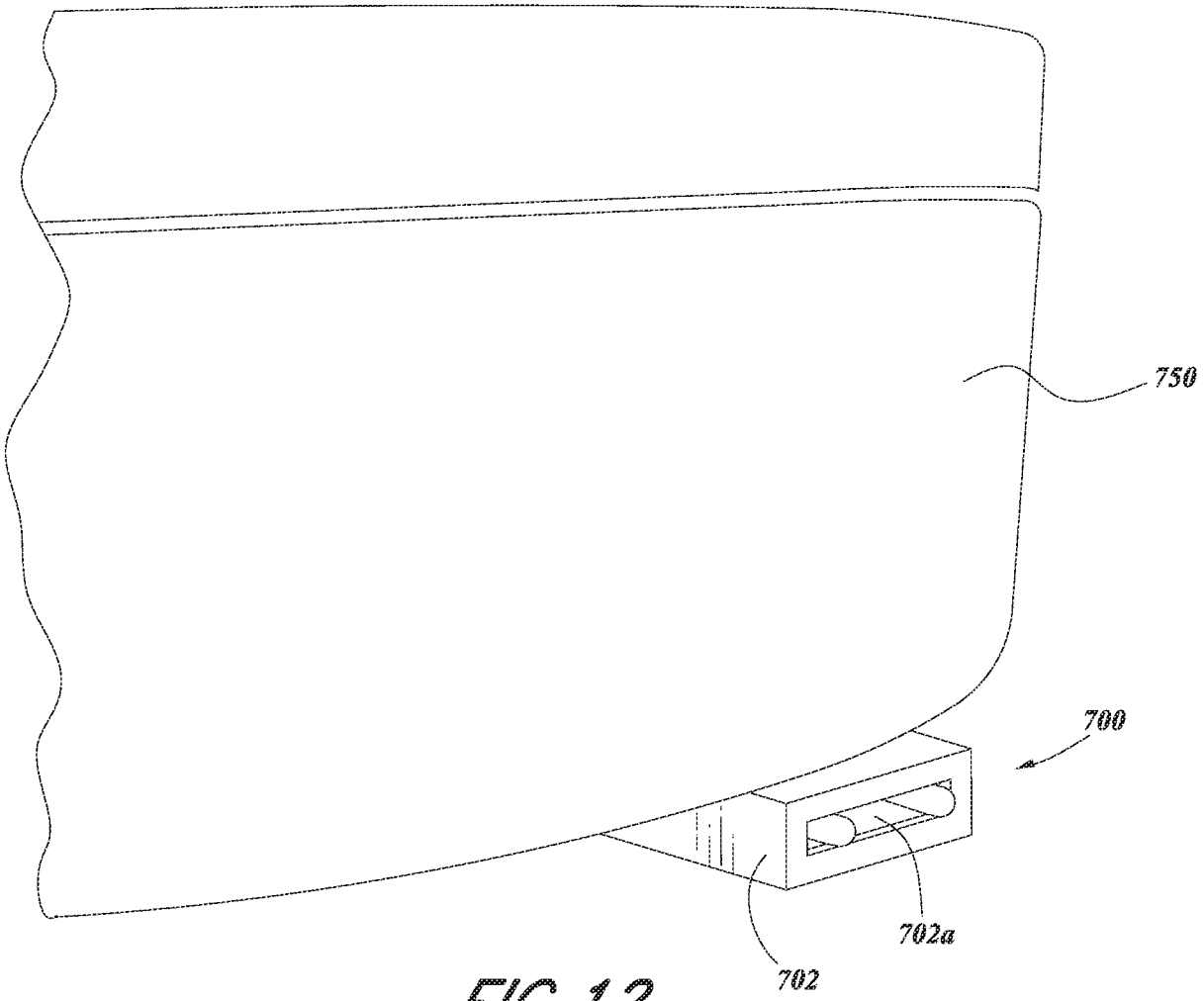
Figure 14:
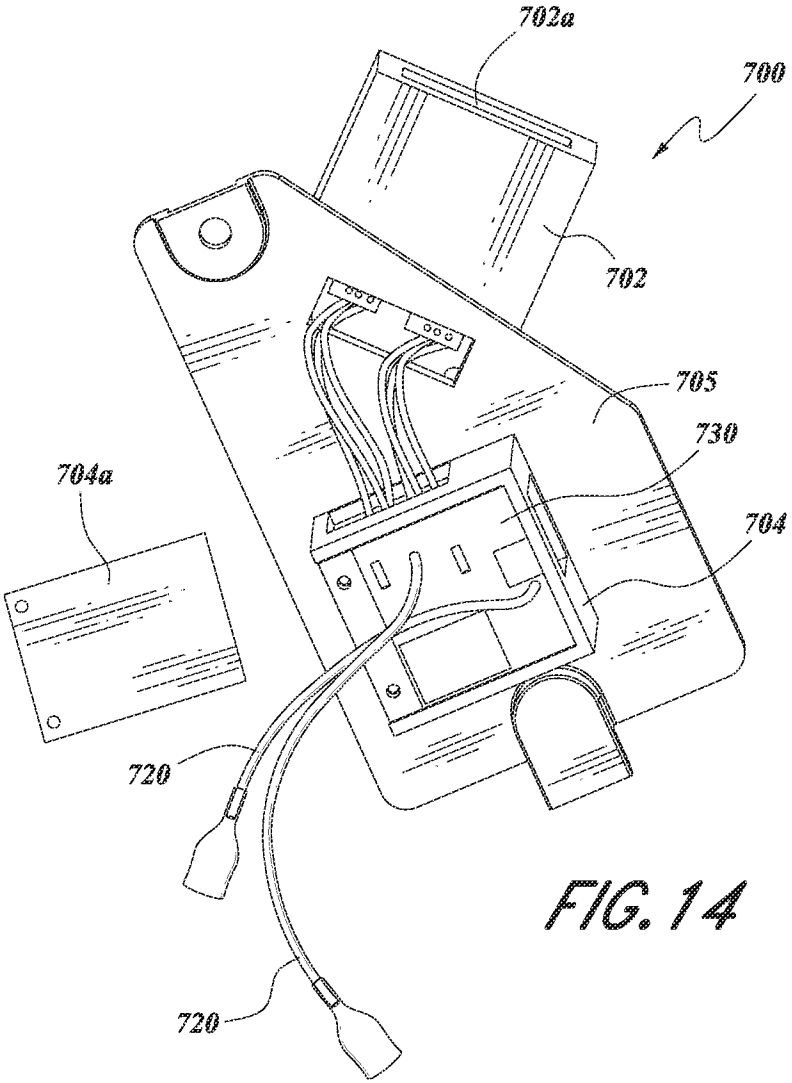
FIGS. 13 and 14 show the retrofit sensor kit shown in FIGS. 10-12 dettached from a drinking fountain.
Figure 13:
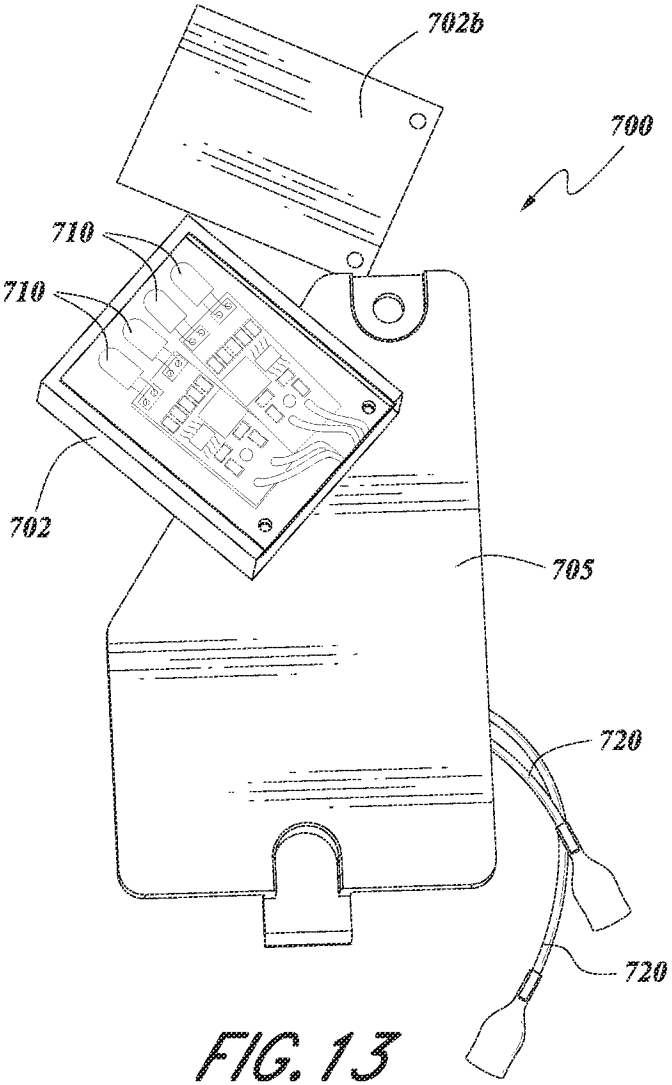

As shown in FIGS. 10 and 12, the first housing portion 702 of the housing 700 can include a window 702*a* and a cover panel 702*b*. The cover panel 702*b* can be attached to the first housing portion using screws. The cover panel 702*b* can prevent users from touching and/or interfering with the sensor 710. The cover panel 702*b* can be removed to replace the sensor 710. The sensor 710 can be positioned inside the first housing portion 702. The window 702*a* of the first housing portion 702 can provide a clear path between the sensor 710 and the drinking fountain's surroundings. Beneficially, this can improve the sensor's 710 ability to detect the conditions that will cause the sensor 710 to activate, as further described below.

Figure 11:
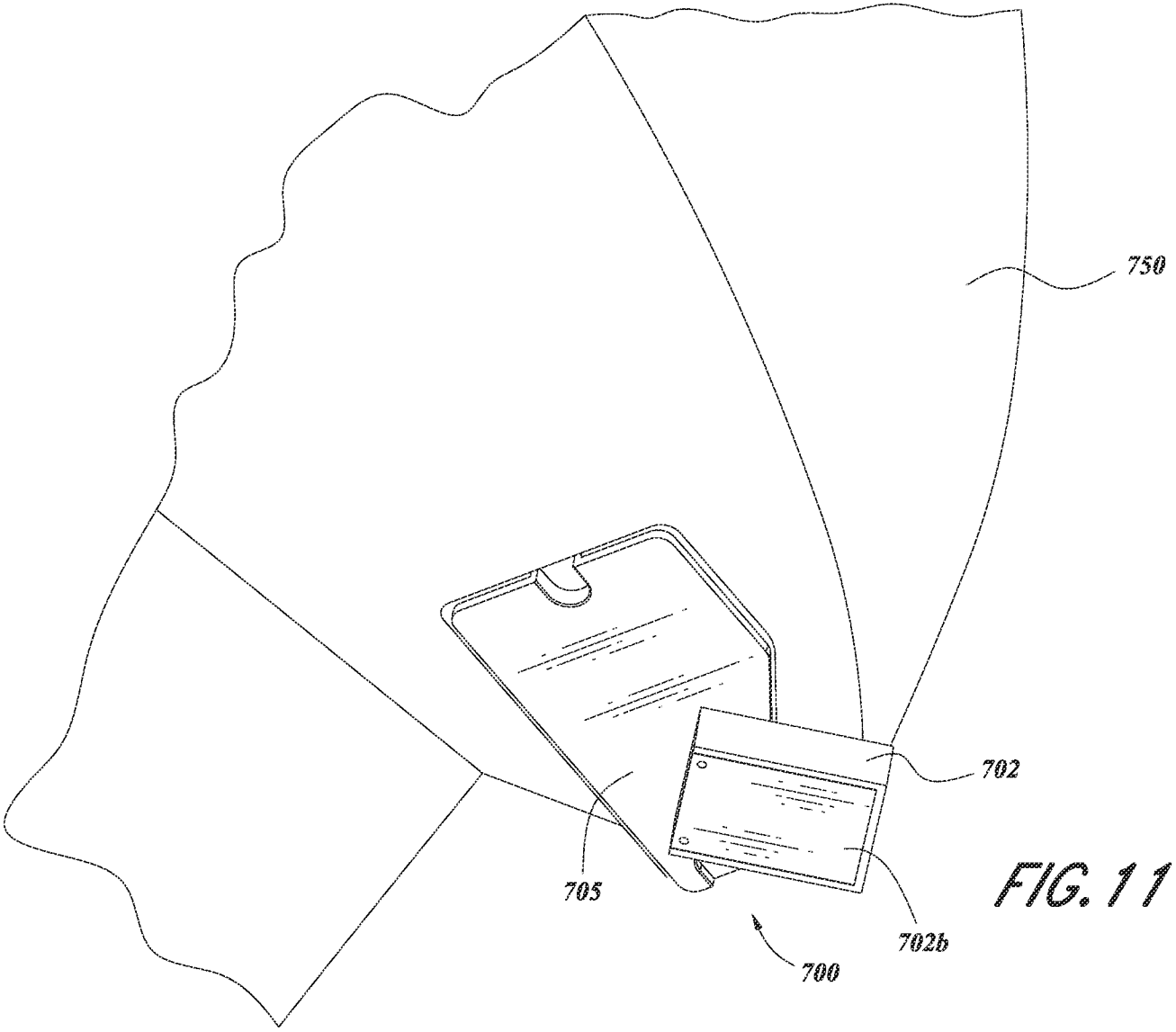

When the housing 700 is attached to the drinking fountain 750, as shown in FIGS. 10-12, the first housing portion 702 can be at least partially exposed. That is, at least a portion of the first housing portion 702, including the window 702*a*, can be located outside an interior portion of the drinking fountain 750. Beneficially, this can allow users to easily identify the location of the sensor 710 which, as previously mentioned, can be located inside the first housing portion 702.

The second housing portion 704 can include a cover panel 704*a*. The cover panel 704*a* can be attached to the second housing portion 704*b* using screws. The cover panel 704*a* can be removed to replace any of the electrical components positioned inside the second housing portion 704. The second housing portion 704 can house at least some of the electrical components of the retrofit sensor kit. For example, the second housing portion 704 can house a printed circuit board (PCB) 730, the switch, the relay 720, and/or a power source, such as a battery. The switch, relay, power source, and sensor 710 can each be integrated with the PCB 730 or be removably connected to the PCB 730. The sensor 710 can be connected to the PCB 730 via wires running from an interior portion of the first housing 702 to the PCB 730 in the second housing portion 704 via the opening 705*a* of the panel 705.

Figure 15:
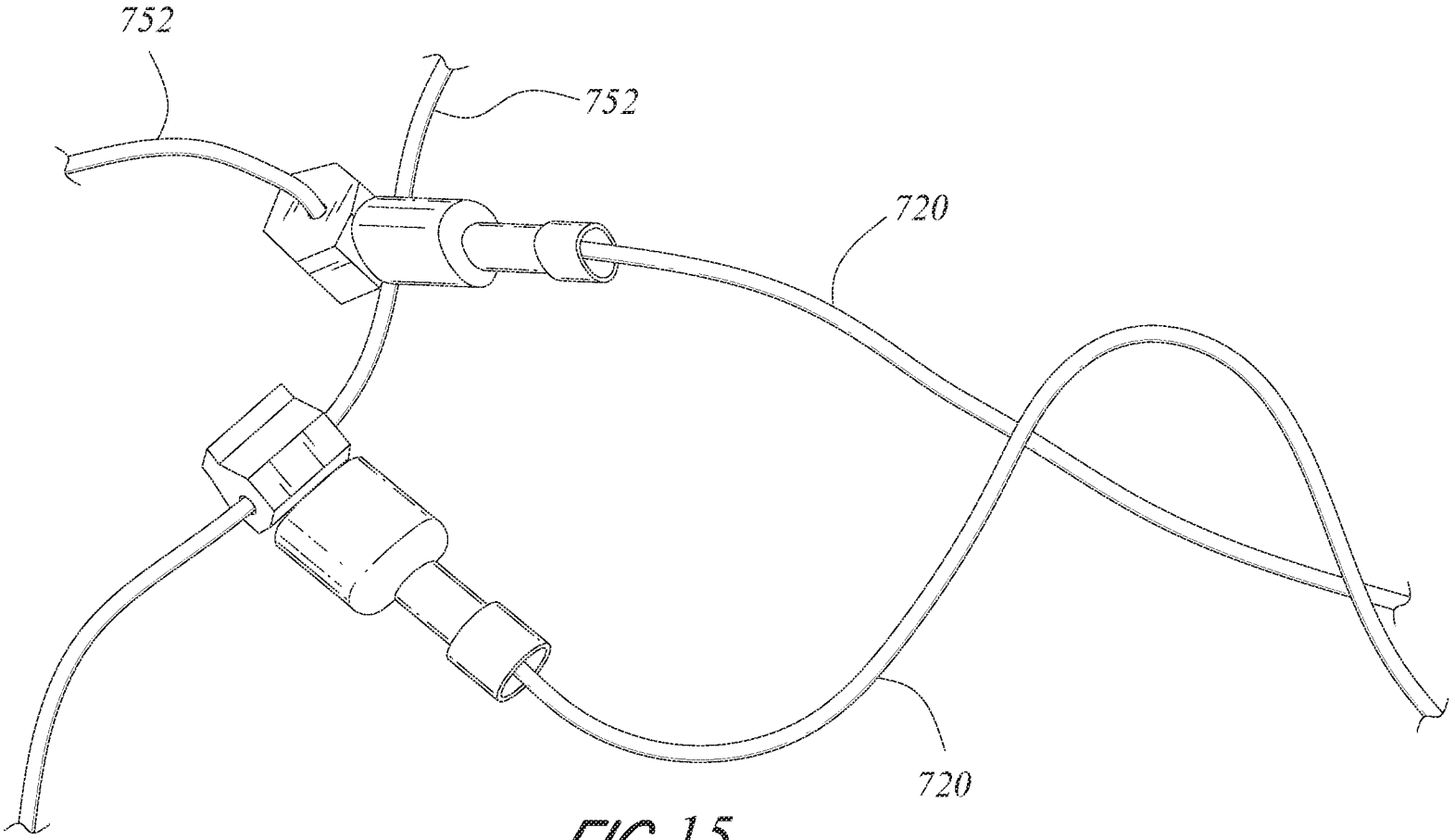
FIG. 15 shows a retrofit sensor kit connected to the activation wires of a drinking fountain.

The retrofit sensor kit can be connected to a drinking fountain 750 using the relay 720. For example, the relay 720 can include one or more wires that can be connected to an activation line 752 of the drinking fountain 750, as shown in FIG. 15. In some cases, the relay 720 can be connected to a power source. The power source can include a battery or a power cord connected to an electrical supply via a wall socket. In some cases, a power source of the drinking fountain 750 can supply energy to the retrofit sensor kit and its components. The relay 720 can cause the power source to energize the activation line 752 of the drinking fountain 750 when the sensor 710 is activated.

The sensor 710 can include a proximity sensor. The proximity sensor can activate after detecting the presence of a user. For example, the proximity sensor can activate when the proximity sensor detects that a user is within a threshold distance of the proximity sensor. In some cases, the sensor can activate after detecting a user gesture or motion. Activating the sensor 710 can cause the drinking fountain 750 to dispense water. For example, activating the sensor 710 can cause the switch to connect the relay 720 to the power source. This, in turn, can cause the relay 720 to energize the activation line 752 of the drinking fountain using energy from the power source causing the drinking fountain to dispense water or other fluids. In some cases, and to prevent users from unintentionally activating the sensor, the sensor can activate after a user has been within a threshold distance of the proximity sensor for a minimum period of time. For example, the sensor can activate after the user has been within a threshold distance/proximity of the proximity sensor for at least 1 second, 2 seconds, 3 seconds, etc. In some cases, the drinking fountain 750 can continue to dispense water until the sensor 710 is deactivated. The sensor 710 can be deactivated, for example, when the sensor no longer detects a user's proximity. Deactivating the sensor 710 can cause the drinking fountain 750 to stop dispensing water. The retrofit sensor kit can operate according to process 350, as shown in FIG. 3B and as described elsewhere herein.

In some cases, the retrofit kit and all its components are located inside the drinking fountain. In such cases, the retrofit can include a sensor positioned inside the drinking fountain. Locating the retrofit kit and its components inside the drinking fountain can beneficially protect the retrofit and its components from tampering and/or the elements, and protect users from any high-voltage components of the retrofit kit. The sensor can wirelessly communicate with electronic devices including phones, laptops, smartwatches, electronic wallets, authorization/ID cards, and/or RFID tags, using Wi-Fi, Bluetooth, NFC, RFID, or any other suitable communication protocols. In some cases, placing an electronic device within the vicinity of the sensor can activate the sensor. For example, an electronic device can broadcast a signal that can be received by the sensor. The signal can indicate that a user is in proximity of the drinking fountain and cause the drinking fountain to dispense a fluid. In some cases, and to prevent users from unintentionally activating the sensor, the sensor can activate after an electronic device has been within a threshold distance/proximity of the sensor for a minimum period of time. For example, the sensor can activate after the electronic device has been within a threshold distance/proximity of the sensor for at least 1 second, 2 seconds, 3 seconds, etc. In some cases, the electronic devices can include a dedicated application and/or function for activating the sensor of the retrofit kit. For example, an electronic device can include a dedicated button and/or touch-screen command that a user can press and/or activate to activate the drinking fountain.

In some cases, retrofitting a drinking fountain 750 with any of the kits or embodiments described herein adds a touch-free dispensing capability to the drinking fountain 750. That is, retrofitting a drinking fountain 750 does not necessarily replace the drinking fountain's 750 original method of operation. For example, pushing a button of a retrofitted drinking fountain 750 can still cause the drinking fountain 750 to dispense water. In some cases, however, the kits and embodiments described herein can be adapted to replace components of a drinking fountain 750. For example, the shape of a retrofit sensor kit can be adapted to substantially replicate the shape of an existing drinking fountain push button (e.g., dispensing button). The push button of the drinking fountain 750 can be removed and replaced with a retrofit sensor kit. The retrofit sensor kit can include any of the components described herein such as a sensor for detecting, for example, a user's proximity.

Although some of the kits and embodiments described herein are shown attached to an exterior portion of a drinking fountain 750, the location of the kits and embodiments described herein and their components can vary. For example, a sensor of the retrofit sensor kit can be attached to a wall adjacent to the drinking fountain 750 (e.g., the wall the drinking fountain 750 is mounted to). In some cases, the retrofit sensor kit can be positioned closer to the ground thereby allowing the sensor to detect the proximity of a user's feet. In some cases, the retrofit sensor kits and sensors described herein can include more than one sensor. For example, a retrofit sensor kit can include a first sensor positioned on a first portion of a drinking fountain and a second sensor positioned on a second portion of the drinking fountain. The first and second portions of the drinking fountain can be on opposite sides/surfaces of the drinking fountain. Having sensors on opposite sides/surfaces of the drinking fountain can beneficially allow users to activate the sensor using their right hand or their left.

The present disclosure includes kits, systems, methods, and retrofits that convert a drinking fountain into touchless or hands-free activated drinking fountain. Accordingly, a touchless circuit determines an activation trigger, and activates an electronic valve or other mechanism to dispense water. In an embodiment, the touchless functionality is provided as an additional activation mechanism. That is, the original functionality remains with the fountain and the touchless activation is in addition to that original, for example, button press-dispense water function. However, an artisan will recognize from the disclosure herein that the touchless functionality could replace the original functionality, such as, for example, when there is a desire to make the drinking fountain more sanitary and less of a high touch surface. The touchless circuit may include a sensor and a relay. In other embodiments, the touch circuit may include communication with virtually any type of computing device. Such communication can provide a straightforward signal for a sensor, or include more sophisticated interaction to authenticate and/or activate the fountain. In some embodiments, an electronic device may broadcast a signal (e.g., Wi-Fi, RFID, other) that is received by the sensor as indicating a patron is within proximity for fountain activation. The touchless circuit may advantageously be provided as a retrofit kit or adopted into the manufacturing processes of new fountains. That is, a fountain manufacturer may advantageously adopt the touchless circuit of the present embodiments into a fountain system as a commercial fountain offering.

Additional Considerations and Terminology

Although this invention has been disclosed in the context of certain preferred embodiments, it should be understood that certain advantages, features and aspects of the systems, devices, and methods may be realized in a variety of other embodiments. Additionally, it is contemplated that various aspects and features described herein can be practiced separately, combined together, or substituted for one another, and that a variety of combination and subcombinations of the features and aspects can be made and still fall within the scope of the invention. Furthermore, the systems and devices described above need not include all of the modules and functions described in the preferred embodiments.

Conditional language used herein, such as, among others, "can," "could," "might," "may," "e.g.," and the like, unless specifically stated otherwise, or otherwise understood within the context as used, is generally intended to convey that certain features, elements, and/or steps are optional. Thus, such conditional language is not generally intended to imply that features, elements, and/or steps are in any way required or that one or more embodiments necessarily include logic for deciding, with or without other input or prompting, whether these features, elements, and/or steps are included or are to be always performed. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. Further, the term "each," as used herein, in addition to having its ordinary meaning, can mean any subset of a set of elements to which the term "each" is applied.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 10 degrees, 5 degrees, 3 degrees, or 1 degree. As another example, in certain embodiments, the terms "generally perpendicular" and "substantially perpendicular" refer to a value, amount, or characteristic that departs from exactly perpendicular by less than or equal to 10 degrees, 5 degrees, 3 degrees, or 1 degree.

Although certain embodiments and examples have been described herein, it will be understood by those skilled in the art that many aspects of the systems and devices shown and described in the present disclosure may be differently combined and/or modified to form still further embodiments or acceptable examples. All such modifications and variations are intended to be included herein within the scope of this disclosure. A wide variety of designs and approaches are possible. No feature, structure, or step disclosed herein is essential or indispensable.

Any methods disclosed herein need not be performed in the order recited. The methods disclosed herein may include certain actions taken by a practitioner; however, they can also include any third-party instruction of those actions, either expressly or by implication.

The methods and tasks described herein may be performed and fully automated by a computer system. The computer system may, in some cases, include multiple distinct computers or computing devices (e.g., physical servers, workstations, storage arrays, cloud computing resources, etc.) that communicate and interoperate over a network to perform the described functions. Each such computing device typically includes a processor (or multiple processors) that executes program instructions or modules stored in a memory or other non-transitory computer-readable storage medium or device (e.g., solid state storage devices, disk drives, etc.). The various functions disclosed herein may be embodied in such program instructions, and/or may be implemented in application-specific circuitry (e.g., ASICs or FPGAs) of the computer system. Where the computer system includes multiple computing devices, these devices may, but need not, be co-located. The results of the disclosed methods and tasks may be persistently stored by transforming physical storage devices, such as solid state memory chips and/or magnetic disks, into a different state. The computer system may be a cloud-based computing system whose processing resources are shared by multiple distinct business entities or other users.

Depending on the embodiment, certain acts, events, or functions of any of the processes or algorithms described herein can be performed in a different sequence, can be added, merged, or left out altogether (for example, not all described operations or events are necessary for the practice of the algorithm). Moreover, in certain embodiments, operations or events can be performed concurrently, e.g., through multi-threaded processing, interrupt processing, or multiple processors or processor cores or on other parallel architectures, rather than sequentially.

Various illustrative logical blocks, modules, routines, and algorithm steps that may be described in connection with the disclosure herein can be implemented as electronic hardware (e.g., ASICs or FPGA devices), computer software that runs on general purpose computer hardware, or combinations of both. Various illustrative components, blocks, and steps may be described herein generally in terms of their functionality. Whether such functionality is implemented as specialized hardware versus software running on general-purpose hardware depends upon the particular application and design constraints imposed on the overall system. The described functionality can be implemented in varying ways for each particular application, but such implementation decisions should not be interpreted as causing a departure from the scope of the disclosure.

Moreover, various illustrative logical blocks and modules that may be described in connection with the disclosure herein can be implemented or performed by a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be a controller, microcontroller, or state machine, combinations of the same, or the like. A processor can include electrical circuitry configured to process computer-executable instructions. A processor can include an FPGA or other programmable device that performs logic operations without processing computer-executable instructions. A processor can also be implemented as a combination of computing devices, e.g., a combination of a DSP and a microprocessor, a plurality of microprocessors, one or more microprocessors in conjunction with a DSP core, or any other such configuration. Although described herein primarily with respect to digital technology, a processor may also include primarily analog components. For example, some or all of the rendering techniques described herein may be implemented in analog circuitry or mixed analog and digital circuitry. A computing environment can include any type of computer system, including, but not limited to, a computer system based on a microprocessor, a mainframe computer, a digital signal processor, a portable computing device, a device controller, or a computational engine within an appliance, to name a few.

The elements of any method, process, routine, or algorithm described in connection with the disclosure herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of a non-transitory computer-readable storage medium. An exemplary storage medium can be coupled to the processor such that the processor can read information from, and write information to, the storage medium. In the alternative, the storage medium can be integral to the processor. The processor and the storage medium can reside in an ASIC. The ASIC can reside in a user terminal. In the alternative, the processor and the storage medium can reside as discrete components in a user terminal.

While the above detailed description has shown, described, and pointed out novel features, it can be understood that various omissions, substitutions, and changes in the form and details of the devices or algorithms illustrated can be made without departing from the spirit of the disclosure. As can be recognized, certain portions of the description herein can be embodied within a form that does not provide all of the features and benefits set forth herein, as some features can be used or practiced separately from others. The scope of certain embodiments disclosed herein is indicated by the appended claims rather than by the foregoing description. All changes which come within the meaning and range of equivalency of the claims are to be embraced within their scope.

What is claimed is:

1. A retrofit kit configured to provide touch free activation to a touch drinking fountain while retaining original drinking fountain functionality, the retrofit kit comprising:

prior to installation on the touch drinking fountain, a kit including:

a housing attachable to a portion of the touch drinking fountain, the housing comprising a first housing portion having a window and a second housing portion;

at least one proximity sensor;

a switch; and at least one relay configured to connect to at least one activation line of the touch drinking fountain;

wherein activating the at least one proximity sensor when the kit is attached to the touch drinking fountain causes the switch to connect the at least one relay to a power source of the touch drinking fountain;

wherein connecting the at least one relay to the power source causes the at least one relay to provide energy to the at least one activation line of the touch drinking fountain;

wherein providing energy to the at least one activation line of the touch drinking fountain causes the touch drinking fountain to dispense a fluid;

wherein the first housing portion is positioned outside the touch drinking fountain when the housing is attached to the touch drinking fountain; and wherein the at least one proximity sensor is in communication with the exterior of the touch drinking fountain through the window.

2. The retrofit kit of claim 1, wherein the at least one proximity sensor activates when the at least one proximity sensor detects a user's proximity.

3. The retrofit kit of claim 1, wherein the at least one proximity sensor activates when the at least one proximity sensor detects a predefined user gesture or motion.

4. The retrofit kit of claim 1, wherein the at least one proximity sensor is attached to an exterior surface of the touch drinking fountain or a surface adjacent to the touch drinking fountain.

5. The retrofit kit of claim 1, wherein the switch and the at least one relay are positioned inside the touch drinking fountain when the kit is installed to the touch drinking fountain.

6. The retrofit kit of claim 1, wherein the at least one relay comprises a relay circuitry and at least one relay wire connected to the relay circuitry.

7. The retrofit kit of claim 6, wherein the switch and the relay circuitry are positioned inside a housing.

8. The retrofit kit of claim 7, wherein the housing is watertight.

9. The retrofit kit of claim 1, wherein the power source comprises at least one of a battery and a power cord connected to an electricity supply via a wall socket.

10. The retrofit kit of claim 1, wherein activating an actuator of the touch drinking fountain also causes the touch drinking fountain to dispense fluid.

11. The retrofit sensor kit of claim 1, wherein the first housing portion comprises a window.

12. A retrofit sensor kit for a touch drinking fountain, the retrofit sensor kit comprising:

a housing attachable to a portion of the touch drinking fountain:

at least one sensor having an activated mode and a deactivated mode;

at least one relay wire connected to at least one activation line of the touch drinking fountain; and a power source;

wherein, when the at least one sensor is in the activated mode, the at least one sensor activates the at least one relay wire;

wherein activating the at least one relay wire causes the power source to energize the at least one activation line of the touch drinking fountain;

wherein energizing the at least one activation line of the touch drinking fountain causes the touch drinking fountain to dispense fluid; and wherein, when the at least one sensor is in the deactivated mode, the touch drinking fountain does not dispense fluid;

wherein the housing includes a first housing portion at least partially exposed when the housing is attached to the touch drinking fountain, a second housing portion positioned inside the touch drinking fountain when the housing is attached to the touch drinking fountain, and a panel between the first and second housing portions, the at least one sensor positioned inside the first housing portion and at least a portion of the at least one relay wire positioned inside the second housing portion.

13. The retrofit sensor kit of claim 12, wherein the at least one sensor comprises a proximity sensor configured to detect a user's proximity.

14. The retrofit sensor kit of claim 13, wherein the proximity sensor transitions from the deactivated mode to the activated mode when the proximity sensor detects the user's proximity.

15. The retrofit sensor kit of claim 13, wherein the proximity sensor transitions from the activated mode to the deactivated mode when the proximity sensor does not detect the user's proximity.

16. The retrofit sensor kit of claim 12, wherein the power source comprises at least one of a battery and a power cord connected to an electricity supply via a wall socket.

17. The retrofit sensor kit of claim 12, wherein activating an actuator of the touch drinking fountain also causes the touch drinking fountain to dispense fluid.

18. The retrofit sensor kit of claim 12, wherein the housing is watertight.

* * * * *